United States Patent [19]

De Ronde

[11] Patent Number: 4,525,690

[45] Date of Patent: Jun. 25, 1985

[54] N-PORT COUPLER

[75] Inventor: Frans C. De Ronde, Lesigny, France

[73] Assignee: U.S. Philips Corporation, New York, N.Y.

[21] Appl. No.: 499,648

[22] Filed: May 31, 1983

[30] Foreign Application Priority Data

May 28, 1982 [FR] France ..... 82 09383

[51] Int. Cl.[3] ..... H01P 5/16; H01P 5/18

[52] U.S. Cl. ..... 333/116; 333/128; 333/238

[58] Field of Search ..... 333/115, 116, 121, 127, 333/128, 136

[56] References Cited

U.S. PATENT DOCUMENTS 3,619,787 11/1971 Salzberg ..... 333/120 X 4,328,471 5/1982 Quine ..... 333/128

*Primary Examiner*—Paul Gensler

*Attorney, Agent, or Firm*—Robert J. Kraus

[57] ABSTRACT

An n-port high frequency coupler for coupling opposite strip-type ports (10*a,* 10*c*) and (20*a,* 20*c*). The coupler includes transmission line stubs (10*b,* 10*d* and 20*b,* 20*d*), each having a width less than the width of the ports and being connected at one end to the corresponding port and electrically connected at the opposite end, in a central zone (40) of the coupler to the other stubs. A resonant transmission line loop is coupled to the stubs at locations which are symmetrically-disposed with respect to the central zone. The loop has a width which is substantially equal to the width of the ports and a mean length effecting establishment of a resonant frequency just below the passband of the coupler.

8 Claims, 4 Drawing Figures

FIG.1
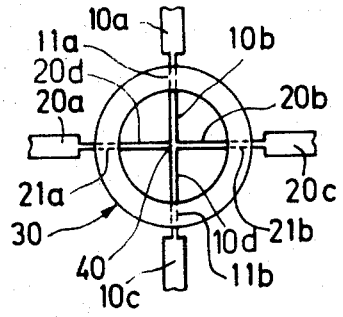
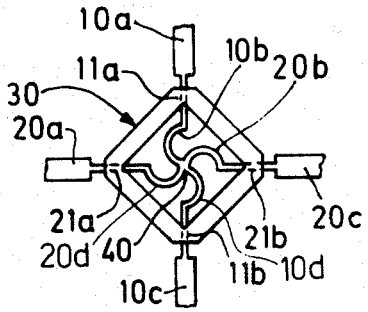
FIG.2
FIG.3
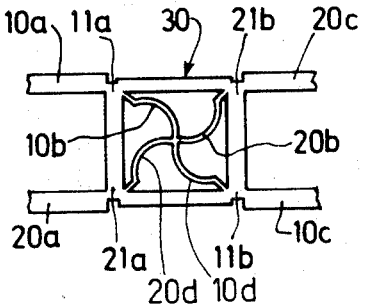
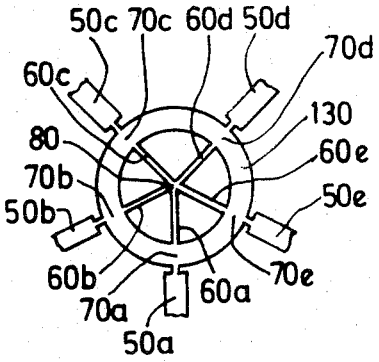
FIG.4

N-PORT COUPLER

BACKGROUND OF THE INVENTION

The present invention relates to an n-port coupler. A passive reciprocal loss-less four-port power divider provides inter alia a directional coupler if each port is matched. In the article "A directional coupler with very flat coupling", published in the periodical IEEE Transactions on Microwave Theory and Techniques, Vol. MTT-26, No. 2, February 1978, pages 70–74, G. P. Riblet proposes a strip-line coupler having an assembly of four quarter-wave length long short-circuited stubs or four open-circuit half-wave stubs located at a distance of a quarter wave from the input ports of the coupler. Such a coupler is also known from the United Kingdom Patent Specification No. 1,582,285. In all of these cases the matching is realized outside the coupler.

In U.S. Pat. No. 4,127,832, as well as in the article "An Eigenadmittance Condition Applicable to Symmetrical Four-Port Circulators and Hybrids", by G. P. Riblet, published in IEEE Transactions on Microwave Theory and Techniques, Vol. MTT-26, No. 4, April 1978, pages 275–279, a strip-line hybrid coupler is suggested which for matching is provided with an assembly of four separated metal plates acting as capacitors and provided inside the coupler, the plates being connected to the four respective input ports by transmission lines. This comparatively compact coupler is, however, actually only adapted to one single frequency as is shown in FIG. 3 of the article.

BACKGROUND OF THE INVENTION

It is an object of the invention to provide a coupler which is both compact and adapted to a frequency band which is higher than the frequency band obtained with prior art constructions.

The invention relates to an n-port coupler having a structure such that it comprises n-transmission line stubs of a width less than the width of strip-type ports. Each stub is connected at one end to a corresponding strip type port and at the other end to the other stubs in a central zone of the coupler. A resonant transmission line loop having a line-width which is substantially equal to the line-width of the ports is coupled to the stubs at symmetrically disposed locations with respect to the central zone. The loop has a mean length such that the resonant frequency is situated just below the passband of the coupler.

This structure has the advantage that the resonant transmission line loop is matched over approximately one octave to each of the line stubs. This matching is in accordance with the dual matching principle described in a very general way by F. C. de Ronde in the article "Full-band matching of waveguide discontinuities" read at the MTT-Symposium held at Palo Alto, United States in 1966.

The n-port coupler can be constructed to be a passive power divider.

BRIEF DESCRIPTION OF THE DRAWING

Further details and advantages of the invention will now be described in greater detail with reference to the accompanying drawing in which:

FIG. 1 illustrates a first embodiment of an n-port coupler in accordance with the invention;

FIG. 2 illustrates a second embodiment of an n-port coupler in accordance with the invention;

FIG. 3 illustrates a third embodiment of an n-port coupler in accordance with the invention; and FIG. 4 illustrates a fourth embodiment of an n-port coupler in accordance with the invention.

DESCRIPTION OF THE PREFERRED EMBODIMENTS

The n-port coupler described with reference to FIGS. 1 and 2 in two strip-line embodiments comprises four input ports 10*a*, 20*a*, 10*c* and 20*c*. These ports are interconnected by four transmission line stubs 10*b*, 20*b*, 10*d* and 20*d*. Stubs 10*b*, 10*d* lie along one axis and stubs 20*b*, 20*d* lie along a perpendicular axis. For a predetermined width of the input ports these stubs have a width which is less than the width of the ports so as to form higher-impedance stubs and are interconnected in the central zone 40 of the coupler.

The coupler also comprises a resonant transmission line loop 30 having a width which is substantially equal to the width of the ports and overlying the four transmission line stubs 10*b*, 20*b*, 10*d* and 20*d* to provide capacitive coupling in the four zones 11*a*, 21*a*, 11*b*, 21*b* where the stubs face the loop. The mean circumference of this loop is chosen such that its resonant frequency is just below the passband of the coupler.

This structure is matched by the use of the duality principle mentioned before and the completely symmetrical structure and operates as a directional coupler. In sprite of the presence of the electrical connection in zone 40 there is no coupling between the elements 10*a*, 10*b*, 10*c*, 10*d* located on one of the axes and the elements 20*a*, 20*b*, 20*c*, 20*d* located on the other, perpendicular axis, over at approximately one octave as the line stubs 10*b*, 10*d*, 20*b* and 20*d* and the loop 30 have inductive and capacitive reactances which substantially compensate each other in such a frequency band.

In the embodiment shown in FIG. 1 the line stubs 10*b*, 10*d* and 20*b*, 20*d* are two-by-two rectilinear and the loop 30 is circular. In the embodiment of FIG. 2 the match has been optimized by increasing the length of the line stubs 10*b*, 10*d*, 20*b* and 20*d* by approximately 10% and by reducing in contrast therewith the width, or mean circumference of the loop 30. The line stubs are now curvilinear, while still remaining two-by-two perpendicular in the central zone. A square shape is adopted for the loop 30 by replacing the four circles of arc forming this network by chords subtending them. It is alternatively possible to adopt only one of these two arrangements.

It will be obvious that the present invention is not limited to the above embodiment, from which variations may be proposed without departing from the scope of the invention. For example, when a microstrip structure is desired instead of a strip-line structure, the coupling between the loop and the line stubs must be a conductive coupling which results in an arrangement as shown in FIG. 3, in which the connection is now an electrical connection between the loop 30 and the line stubs 10*b*, 10*d*, 20*b* and 20*d* at the four zones 11*a*, 21*a*, 11*b*, 21*b* which are common to the loop and the line stubs. This embodiment produces a slight reduction of the passband. It is alternatively possible to give the line stubs a variable width, increasing or decreasing from one end to the other, to obtain an impedance transformation too.

On the other hand an embodiment similar to the embodiment of the high frequency coupler described can be used as a passive power divider circuit, e.g. having 5 ports 50*a* to 50*e*. As FIG. 4 shows, these ports having a predetermind width are distributed symmetrically and five transmission line stubs 60*a* to 60*e*, which have a width less than the width of the lines to provide stubs having an impedance higher than the impedance of the ports, are arranged radially between the ports and the central zone 80 which is in common to these stubs. A transmission line loop 130 having a width which is substantially equal to or somewhat less than the width of the ports is connected near the ports to the transmission line stubs 60*a* to 60*e* in the zones 70*a* to 70*e* in such a way as to surround these stubs symmetrically alternatively the loop may be capacitively-coupled to the stubs.

The power divider circuit of this structure wherein n=5 has been realized more specifically for the frequency band between 4 and 8 gigahertz with the following dimensions in an embodiment on a quartz substrate 1.5 mm thick: width of the ports=3 mm, width of the loop=2 mm, width of the 5 transmission line-stubs=0.5 mm, outside diameter of the loop=approximately 17 mm. It was observed that the reflections in the region of each port remained very weak and that the power unbalance was not more than 0.5 dB.

It will be noted here that the matching realized in accordance with the invention in the examples of the above described couplers may be put into effect in other types of couplers, more specifically in impedance transformation couplers such as the coupler described in U.S. Pat. No. 4,305,043, or in coupler-transformer links described in the article by L. F. Lind published in the periodical IEEE Transactions on Microwave Theory and Techniques, Vol. MTT-17, No. 1, January 1969, pages 45–48.

The invention is not limited by the technological aspects of its construction. Actually, precise examples have been given of embodiments in strip-line and microstrip technique, but the invention is also applicable to so-called coplanar structures or to arrangements using periodic transmission for monolithic high frequency circuits, such as those described in United Kingdom Patent Specification No. 2,056,783, or in lumped element structures.

What is claimed is:

1. An n-port coupler for coupling n strip-type transmission line ports, said coupler comprising:

(a) n strip-type stubs each electrically-connected at one end to a respective one of the ports and electrically-connected at an opposite end to the other stubs in a central zone of the coupler, said stubs each having a width substantially smaller than the strip width of the ports; and (b) a strip-type transmission line loop coupled to the stubs at locations which are symmetrically disposed with respect to the central zone, said loop having a width substantially equal to the strip width of the ports and having a mean length effecting establishment of a resonant frequency just below a predefined passband of the coupler.

2. An n-port coupler as in claim 1 where the loop is capacitively coupled to the stubs at said symmetrically-disposed locations.

3. An n-port coupler as in claim 1 where the loop is electrically connected to the stubs at said symmetrically-disposed locations.

4. An n-port coupler as in claim 1 including first and second pairs of aligned ones of the stubs, said first and second pairs of stubs being perpendicularly disposed with respect to each other at least in said central zone.

5. An n-port coupler as in claim 4 where said loop is circular.

6. An n-port coupler as in claim 4 where each stub is curvilinear over a part of its length, and where said loop is square-shaped and is coupled to the stubs at corners of the square.

7. An n-port coupler as in claim 6 where said loop is electrically-connected to the stubs at said corners.

8. An n-port coupler as in claim 1, 2, 3, 4, 5, 6, or 7 where n=5.

* * * * *